US008717136B2

(12) United States Patent
Fontana, Jr. et al.

(10) Patent No.: US 8,717,136 B2
(45) Date of Patent: May 6, 2014

(54) INDUCTOR WITH LAMINATED YOKE

(75) Inventors: Robert E. Fontana, Jr., San Jose, CA (US); William J. Gallagher, Ardsley, NY (US); Philipp Herget, San Jose, CA (US); Eugene J. O'Sullivan, Nyack, NY (US); Lubomyr T. Romankiw, Briancliff Manor, NY (US); Naigang Wang, Ossining, NY (US); Bucknell C. Webb, Ossining, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/347,571

(22) Filed: Jan. 10, 2012

(65) Prior Publication Data

US 2013/0176095 A1 Jul. 11, 2013

(51) Int. Cl.

| | |
|---|---|
| ***H01F 27/30*** | (2006.01) |
| ***H01F 5/00*** | (2006.01) |
| ***H01F 27/28*** | (2006.01) |
| ***H01F 27/24*** | (2006.01) |

(52) U.S. Cl.
USPC ..... 336/199; 336/207; 336/200; 336/223; 336/232; 336/212

(58) Field of Classification Search
USPC ..... 336/200, 223, 232
See application file for complete search history.

(56) References Cited

U.S. PATENT DOCUMENTS

| | | | | |
|---|---|---|---|---|
| 4,959,631 | A | 9/1990 | Hasegawa et al. | |
| 5,398,400 | A | 3/1995 | Breen | |
| 5,450,755 | A * | 9/1995 | Saito et al. | 73/763 |
| 5,805,043 | A | 9/1998 | Bahl | |
| 5,884,990 | A | 3/1999 | Burghartz et al. | |
| 6,002,161 | A | 12/1999 | Yamazaki | |
| 6,114,937 | A | 9/2000 | Burghartz et al. | |
| 6,259,583 | B1 * | 7/2001 | Fontana et al. | 360/125.5 |
| 6,369,683 | B1 | 4/2002 | Iida et al. | |
| 6,573,822 | B2 | 6/2003 | Ma et al. | |
| 6,649,422 | B2 | 11/2003 | Kossives et al. | |
| 6,710,671 | B1 | 3/2004 | Tanaka | |
| 6,722,017 | B2 | 4/2004 | Rittner et al. | |
| 6,856,225 | B1 | 2/2005 | Chua et al. | |
| 6,890,829 | B2 | 5/2005 | Cheng et al. | |
| 6,927,662 | B2 | 8/2005 | Kahlmann et al. | |
| 7,064,645 | B2 | 6/2006 | Kobayashi et al. | |
| 7,414,506 | B2 | 8/2008 | Furumiya et al. | |
| 7,429,779 | B2 | 9/2008 | Itoi et al. | |
| 7,470,927 | B2 | 12/2008 | Lee et al. | |
| 7,541,220 | B2 | 6/2009 | Bambridge et al. | |
| 7,638,406 | B2 | 12/2009 | Edelstein et al. | |
| 7,714,688 | B2 | 5/2010 | Korony et al. | |
| 7,746,232 | B2 | 6/2010 | Hashimoto | |
| 7,790,503 | B2 | 9/2010 | Lin et al. | |
| 7,791,836 | B2 | 9/2010 | Masai | |

(Continued)

OTHER PUBLICATIONS

U.S. Appl. No. 13/477,978 filed May 22, 2012.
Breen et al., "Technical Information: The Accu-L Multi-Layer Inductor for High Frequency Applications," AVX Corporation. AVX Israel Ltd., date unknown.
Karimian, Shokrollah, "Skin Effect Suppression in Multilayer Thin-Film Spiral Inductor Taking Advantage of Negative Permeability of Magnetic Film," Dec. 8, 2010.

(Continued)

*Primary Examiner* — Elvin G Enad
*Assistant Examiner* — Ronald Hinson
(74) *Attorney, Agent, or Firm* — Zilka-Kotab, PC

(57) ABSTRACT

A thin film inductor having yokes, one or more of which is laminated, and one or more conductors passing between the yokes. The laminated yoke or yokes help reduce eddy currents and/or hysteresis losses.

15 Claims, 7 Drawing Sheets

(56) References Cited

U.S. PATENT DOCUMENTS

| | | | |
|---|---|---|---|
| 7,829,427 | B2 | 11/2010 | Edelstein et al. |
| 7,847,668 | B2 | 12/2010 | Lai et al. |
| 7,847,669 | B2 | 12/2010 | Ayazi et al. |
| 7,863,654 | B2 | 1/2011 | Lin |
| 7,969,274 | B2 | 6/2011 | Brennan et al. |
| 7,994,890 | B2 | 8/2011 | Edo et al. |
| 2007/0202684 | A1 | 8/2007 | Lin |
| 2009/0315662 | A1 | 12/2009 | Hijioka et al. |
| 2013/0106552 | A1 | 5/2013 | Fontana, Jr. et al. |

OTHER PUBLICATIONS

U.S. Appl. No. 13/287,942 filed on Nov. 2, 2011.
Non-Final Office Action from U.S. Appl. No. 13/287,942, dated Jan. 17, 2013.
Final Office Action from U.S. Appl. No. 13/287,942 dated Jul. 10, 2013.
Restriction/Election Requirement from U.S. Appl. No. 13/477,978, dated Oct. 25, 2013.
Non-Final Office Action from U.S. Appl. No. 13/287,942 dated Nov. 19, 2013.

* cited by examiner

INDUCTOR WITH LAMINATED YOKE

BACKGROUND

The present invention relates to inductors, and more particularly, this invention relates to thin film ferromagnetic inductors having at least one laminated yoke.

The integration of inductive power converters onto silicon is one path to reducing the cost, weight, and size of electronics devices. One main challenge to developing a fully integrated power converter is the development of high quality thin film inductors. Thin film inductors for power conversion applications should store a large amount of energy per unit area to fit in the limited space on silicon. To accomplish this, ferromagnetic materials are used to increase the energy stored for a given current. However, ferromagnetic materials also introduce some disadvantages. Magnetic materials operating at high frequency produce losses through eddy currents and hysteresis. The eddy currents are created when the time varying magnetic fields in the yokes create an electric field that drives a circular current flow. These losses can be substantial and increase with the thickness of the yoke, and driving frequency of the inductor. Hysteresis losses can be created by magnetic domain walls in the yoke material. To enable efficient power conversion it is therefore critical to reduce the eddy current and hysteresis losses in the yokes.

SUMMARY

A thin film inductor according to one embodiment includes a bottom yoke; a top yoke above the bottom yoke; one or more conductors passing between the yokes and separated therefrom by an insulating material; wherein at least one of the yokes has a laminate structure comprising a first ferromagnetic layer, a nonmagnetic layer above the first ferromagnetic layer, and a second ferromagnetic layer above the first ferromagnetic layer, wherein a width of the first ferromagnetic layer is different than a width of the second ferromagnetic layer in a direction parallel to a plane of deposition of the first ferromagnetic layer.

A system according to one embodiment includes an electronic device; and a power supply or power converter incorporating a thin film inductor as recited herein.

A method according to one embodiment includes forming a bottom yoke above a substrate; forming one or more conductors above the bottom yoke and separated therefrom by an insulating material; and forming a top yoke above the one or more conductors and separated therefrom by an insulating material. At least one of forming the bottom yoke and forming the top yoke includes a procedure comprising: applying a first mask; depositing a first ferromagnetic layer in an area not masked by the first mask; depositing a nonmagnetic layer above the first ferromagnetic layer; applying a second mask above the nonmagnetic layer; and depositing a second ferromagnetic layer in an area not masked by the second mask.

Other aspects and embodiments of the present invention will become apparent from the following detailed description, which, when taken in conjunction with the drawings, illustrate by way of example the principles of the invention.

DETAILED DESCRIPTION

Figure 1:
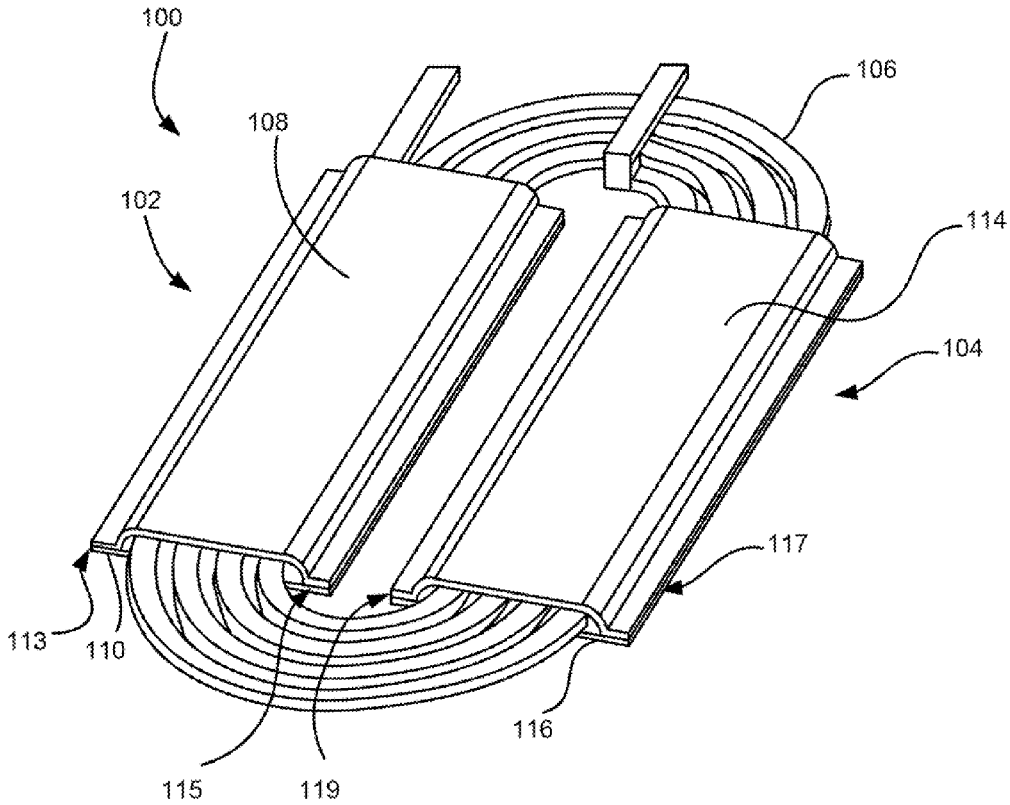
FIG. 1 is a perspective view of a thin film inductor according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The following description discloses several preferred embodiments of thin film inductor structures having conductors surrounded by a ferromagnetic yoke with a magnetic top section and a magnetic bottom section. At least one of the yokes is laminated. The resulting inductors, according to various embodiments, exhibit a reduced loss due to eddy currents.

Thin film inductor technology is one path to integrating power conversion onto silicon, which can bring about a number of advantages including reduced cost, weight, and size of electronics devices. The thin film inductor technology may also become important for future microprocessor power conversion needs where the proximity of the power converter to the processor brings about many advantages.

Thin film inductors for power conversion applications should store a large amount of energy per unit area to fit in the limited space on silicon. To accomplish this, ferromagnetic materials are used to increase the energy stored for a given current. However, ferromagnetic materials also introduce some disadvantages. Magnetic materials operating at high frequency produce losses through eddy currents and hysteresis.

The eddy currents are created when the time varying magnetic fields in the yokes create an electric field that drives a circular current flow. These losses can be substantial and increase with the thickness of the yoke, and driving frequency of the inductor. Hysteresis losses can be created by magnetic domain walls in the yoke material. To enable efficient power conversion it is therefore critical to reduce the eddy current and hysteresis losses in the yokes.

One method of reducing the losses while retaining a large yoke thickness is to construct the yoke out of multiple layers of magnetic material separated by insulating or non-magnetic spacer layers. In the case of insulating spacer layers, each spacer prevents current from flowing between the adjacent magnetic layers and thus reduces the eddy current losses. The advantage in this case depends on the resistivity of the layers. In the case of conductive non-magnetic layers there is no reduction of eddy current, however the separation of the magnetic layers allows the magnetization in adjacent yoke layers to be oriented in opposite directions with flux closure at the edges of the structure. This can eliminate domain walls from the inductor and significantly reduce hysteresis losses.

In various embodiments of the present invention, one or more insulators are incorporated, thereby effectively separating the area of the yoke into thinner laminated layers. The laminations may be placed in the yokes in order to reduce the losses in the yokes. In other approaches, a nonmagnetic layer may be used to separate laminated layers of the yoke. The nonmagnetic layer may or may not be electrically insulating.

In one general embodiment, a thin film inductor includes a bottom yoke; a top yoke above the bottom yoke; one or more conductors passing between the yokes and separated therefrom by an insulating material; wherein at least one of the yokes has a laminate structure comprising a first ferromagnetic layer, a nonmagnetic layer above the first ferromagnetic layer, and a second ferromagnetic layer above the first ferromagnetic layer, wherein a width of the first ferromagnetic layer is different than a width of the second ferromagnetic layer in a direction parallel to a plane of deposition of the first ferromagnetic layer.

In another general embodiment, a system includes an electronic device; and a power supply or power converter incorporating a thin film inductor as recited herein.

In another general embodiment, a method includes forming a bottom yoke above a substrate; forming one or more conductors above the bottom yoke and separated therefrom by an insulating material; and forming a top yoke above the one or more conductors and separated therefrom by an insulating material. At least one of forming the bottom yoke and forming the top yoke includes a procedure comprising: applying a first mask; depositing a first ferromagnetic layer in an area not masked by the first mask; depositing a nonmagnetic layer above the first ferromagnetic layer; applying a second mask above the nonmagnetic layer; and depositing a second ferromagnetic layer in an area not masked by the second mask.

Referring to FIG. 1, there is shown one embodiment of a thin film inductor 100 having two arms 102, 104 and a conductor 106 passing through each arm. The conductor in this case has several turns in a spiral configuration, but in other approaches may have a single turn. In further approaches, multiple conductors, each having one or more turns, may be employed. Moreover, a thin film inductor in further embodiments may have a single arm, which itself may have a single top and bottom yoke, or multiple top and bottom yokes.

A first ferromagnetic top yoke 108 and bottom yoke 110 wrap around the one or more conductors in a first of the arms 102. On either side of the conductor 106 are via regions 113 and 115, where the ferromagnetic top yoke 108 and ferromagnetic bottom yoke 110 are coupled through a low reluctance path.

A second pairing of a ferromagnetic top yoke 114 and bottom yoke 116 wraps around the one or more conductors in a second of the arms 104. Furthermore, ferromagnetic top yoke 114 and ferromagnetic bottom yoke 116 are coupled together through a low reluctance path at the via regions 117, 119.

Figure 2A:
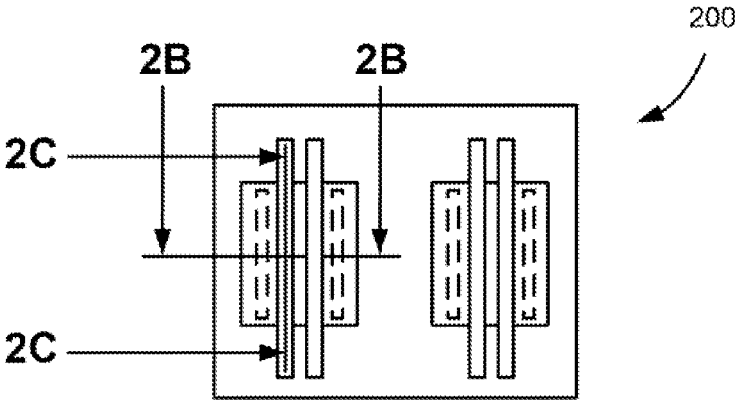
FIG. 2A is a top view of a thin film inductor according to one embodiment.
Figure 2B:
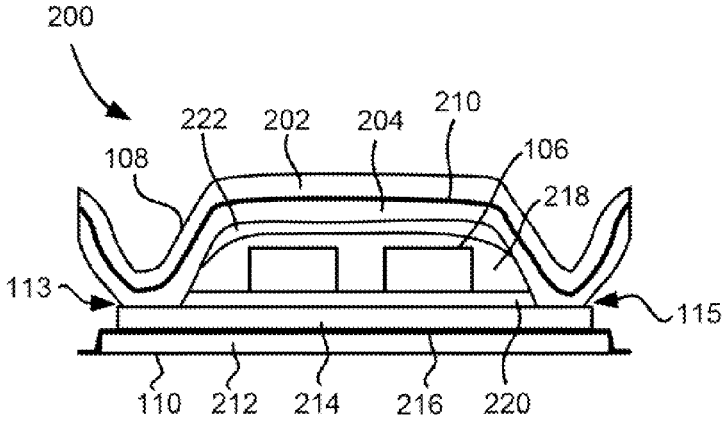
FIG. 2B is a cross sectional view of a thin film inductor according to one embodiment.

FIG. 2B depicts a cross sectional view of a thin film inductor 200, as seen in FIG. 2A, having one particular laminated yoke configuration. The inductor 200 has a top yoke 108 and bottom yoke 110, which sandwich one or more conductors 106. At least one of the yokes has a laminate structure comprising a first ferromagnetic layer, a nonmagnetic, or insulating layer above the first ferromagnetic layer, and a second ferromagnetic layer above the first ferromagnetic layer.

The particular configuration of FIG. 2B shows a laminated top yoke 108, having two discrete plated ferromagnetic layers 202 and 204, which are separated by a nonmagnetic layer 210, which may or may not be insulating. On either side of the conductors 106 are via regions 113 and 115, where the ferromagnetic top yoke 108 and ferromagnetic bottom yoke 110 are coupled through a low reluctance path. This configuration also shows a bottom laminated yoke 110, having two discrete plated ferromagnetic layers 212 and 214 which are separated by an insulating layer 216.

Figure 2C:
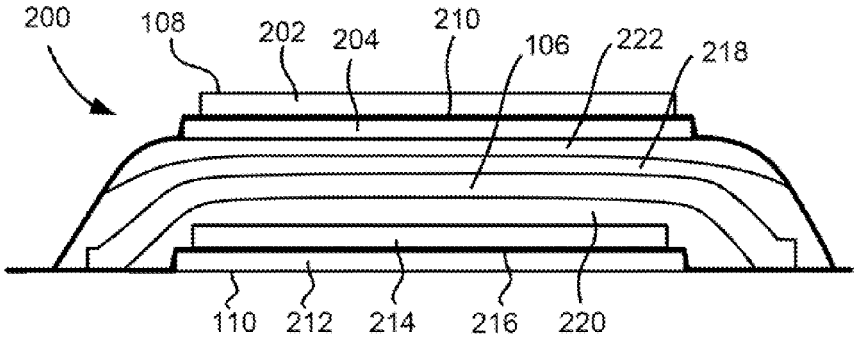
FIG. 2C is a cross sectional view of a thin film inductor according to one embodiment.

FIG. 2C depicts a cross sectional view of a thin film inductor 200, as seen in FIG. 2A. The inductor 200 has a laminated top yoke 108, having two discrete plated ferromagnetic layers 202 and 204, which are separated by a nonmagnetic layer 210. This configuration also shows a bottom laminated yoke 110, having two discrete plated ferromagnetic layers 212 and 214 which are separated by an insulating layer 216.

The width of the first ferromagnetic layer in either or both of the yokes 108, 110 may be different than the width of the second ferromagnetic layer thereof in a direction parallel to a plane of deposition of the first ferromagnetic layer. This variation in width may occur in a direction parallel to the longitudinal axes of the conductors 106 and/or the direction perpendicular thereto.

With continued reference to FIGS. 2B and 2C, the coils 106 may be separated from the top and bottom yokes by a layer of electrically insulating material 218 and 220 respectively. Preferably, each layer of electrically insulating material has physical and structural characteristics of being created by a single layer deposition. For example, the electrically insulating material may have a structure having no transition or interface that would be characteristic of multiple deposition processes; rather the layer is a single contiguous layer without such transition or interface. Such layer may be formed by a single deposition process such as sputtering, spincoating, etc. that forms the layer of electrically insulating material to the desired thickness, or greater than the desired thickness (and subsequently reduced via a subtractive process such as etching, milling, etc.).

With continued reference to FIGS. 2B and 2C, as an option, a photoresist or other polymeric or organic layer 222 may be formed above the insulating layer 218 to provide improvement in the planarity of the top yoke over the coil, increased coupling efficiency of the inductor, and/or minimizes coil shorting between the coil and the top yoke.

In one approach, the first and second ferromagnetic layers are plated layers. In another approach, only one of the ferromagnetic layers is plated. In yet another approach, at least one of the ferromagnetic layers is formed by a dry process known in the art, such as sputtering, ion beam deposition (IBD), etc.

In the via regions having the low reluctance path between the top and bottom yokes, the magnetic layers may be in direct contact, or may be separated by a thin nonmagnetic layer, which may be any nonmagnetic material known in the art, such as ruthenium, copper, gold, alumina, silicon oxides, polymers, etc.

Figure 3A:
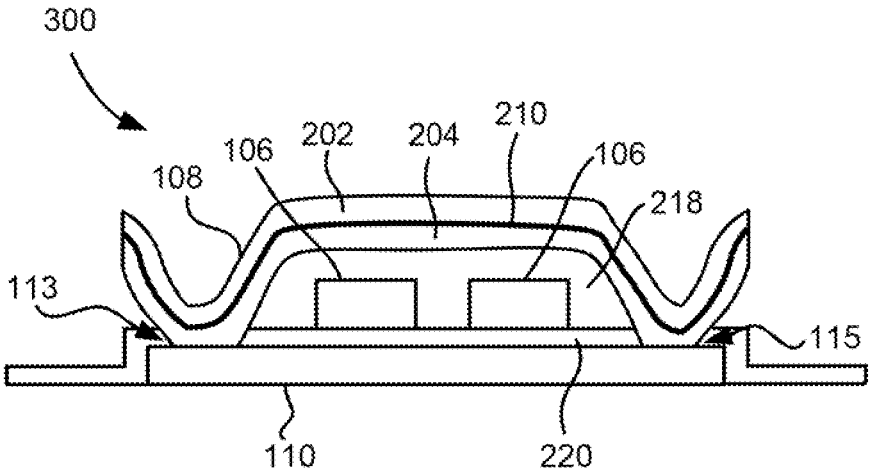
FIG. 3A is a cross sectional view of a thin film inductor according to one embodiment.

FIG. 3A depicts a cross sectional view of a thin film inductor 300 having a particular laminated yoke configuration, as an alternate embodiment to that seen in FIGS. 2A-2C. The inductor 300 has a top yoke 108 and bottom yoke 110, which wrap around one or more conductors 106. The top yoke 108 has a laminate structure comprising a first ferromagnetic layer 204, a nonmagnetic layer 210 above the first ferromagnetic layer, and a second ferromagnetic layer 202 above the first ferromagnetic layer.

The particular configuration of FIG. 3A shows a laminated top yoke 108, having two discrete plated ferromagnetic layers 202 and 204, which are separated by a nonmagnetic layer 210. This configuration also shows a bottom yoke 110. On either side of the conductor 106 are via regions 113 and 115, where the ferromagnetic top yoke 108 and ferromagnetic bottom yoke 110 are coupled through a low reluctance path.

Figure 3B:
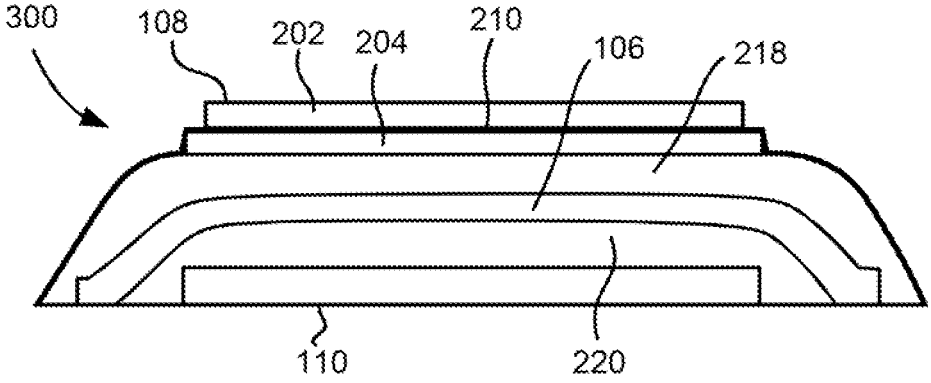
FIG. 3B is a cross sectional view of a thin film inductor according to one embodiment.

FIG. 3B depicts a cross sectional view of a thin film inductor 300, as an alternate embodiment to that seen in FIGS. 2A-2C. The inductor 300 has a laminated top yoke 108, having two discrete plated ferromagnetic layers 202 and 204, which are separated by a nonmagnetic layer 210. This configuration also shows a bottom yoke 110. With continued reference to FIGS. 3A and 3B, the coils 106 may be separated from the bottom and top yokes by a layer of electrically insulating material 218 and 220 respectively.

Figure 4A:
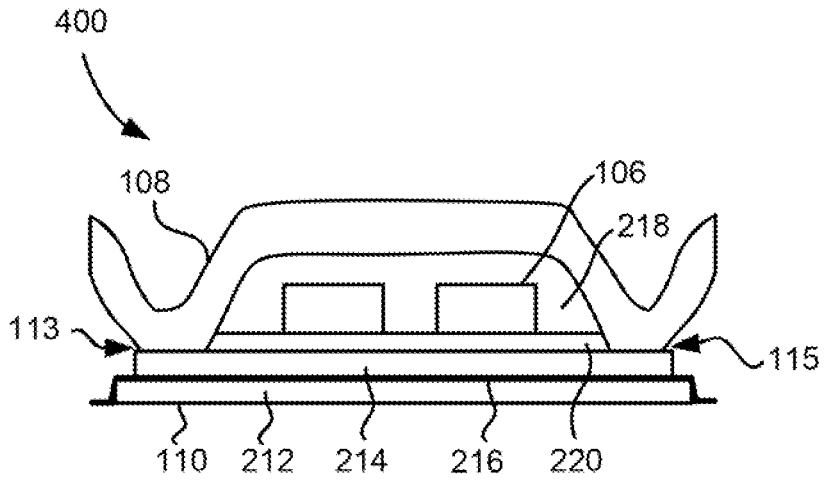
FIG. 4A is a cross sectional view of a thin film inductor according to one embodiment.

FIG. 4A depicts a cross sectional view of a thin film inductor 400 having a particular laminated yoke configuration, as an alternate embodiment to that seen in FIG. 2B as well as FIG. 3A. The inductor 400 has a top yoke 108 and bottom yoke 110, which wrap around one or more conductors 106. In this embodiment, the bottom yoke 110 has a laminate structure comprising a first ferromagnetic layer, a nonmagnetic layer above the first ferromagnetic layer, and a second ferromagnetic layer above the first ferromagnetic layer.

The particular configuration of FIG. 4A shows a top yoke 108. This configuration also shows a bottom laminated yoke 110, having two discrete plated ferromagnetic layers 212 and 214 which are separated by an insulating layer 216. On either side of the conductor 106 are via regions 113 and 115, where the ferromagnetic top yoke 108 and ferromagnetic bottom yoke 110 are coupled through a low reluctance path.

Figure 4B:
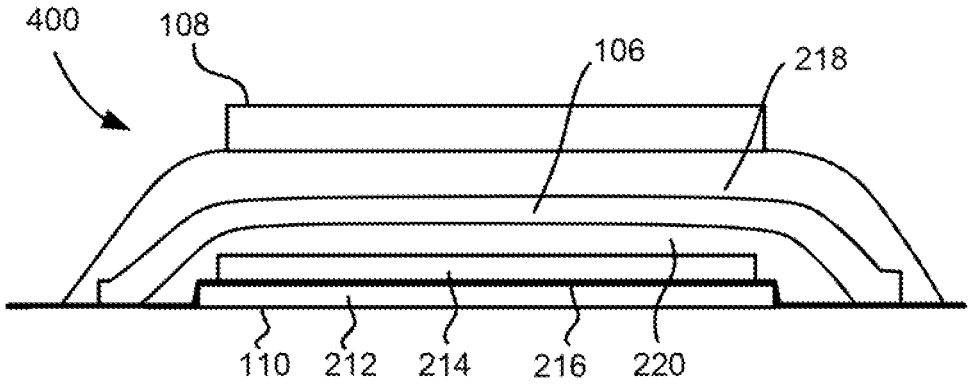
FIG. 4B is a cross sectional view of a thin film inductor according to one embodiment.

FIG. 4B depicts a cross sectional view of a thin film inductor 400, as an alternate embodiment to that seen in FIG. 2C as well as FIG. 3B. The inductor 400 has a top yoke 108. This configuration also shows a bottom laminated yoke 110, having two discrete plated ferromagnetic layers 212 and 214 which are separated by an insulating layer 216. With continued reference to FIGS. 4A and 4B, the coils 106 may be separated from the bottom and top yokes by a layer of electrically insulating material 218 and 220 respectively.

In one approach, the laminate structure of at least one of the yokes further comprises a second nonmagnetic layer above the second ferromagnetic layer, and a third ferromagnetic layer above the second nonmagnetic layer. Where the nonmagnetic layers are insulators, this configuration effectively breaks the electrical conduction path, thus reducing the current losses within the yokes. This design strategy may be used to further decrease losses in the yokes by further increasing the number of layers that are created in either or each of the yokes.

Several methods for constructing structures of the various embodiments of the present invention are possible. In one approach, a wet etch is used on full film yokes masked by photoresist. However, this process was deemed to cause the laminated layers to become very thick thus making it difficult to wet etch and produce a reliable structure.

Another process for forming laminated yokes is electroplating in which a seed layer would be formed, followed by a layer of patterned photo resist, followed by plating the bottom layer of the yoke. Subsequently, a nonmagnetic layer would be formed, which has to be conducting to plate on. Where the nonmagnetic layer is insulating, formation of an overlying laminate is inhibited, and additional processing steps and cost would have to be incurred. Finally another magnetic layer is plated above the nonmagnetic layer. However, this process favors the laminates that are both nonmagnetic and electrically insulating, which ultimately makes this process ineffective.

According to a preferred embodiment, each ferromagnetic layer of the yoke structure is plated using a separate resist mask and using a separate dry deposition of insulation material to form the lamination layers of the yoke. Consequently, each yoke is electroplated in two separate steps. In this manner any insulation material such as, but not limited to $SiO_x$, $AlO_x$, SiN, etc. can be selected, and the insulation layer need not be etched, and electroplating of the yoke layers can be retained. One result of this process is that the lateral extent of the first ferromagnetic layer of the yoke formed by electroplating may be greater than subsequent ferromagnetic layers of the yoke formed by electroplating. More specifically, an inductor with laminated top and/or bottom yokes with the respective yoke being formed by multiple resist steps corresponding to the number of ferromagnetic layers in the top and/or bottom yoke.

For each layer of laminated ferromagnetic material, it is preferred that a separate photolithography mask step, a separate seed layer and a separate plating step are implemented, with insulating laminate layers that are dry deposited and that are not etched during the patterning process to form the yokes. The separate lithography steps therefore result in the lateral extents of the outside edges of each successive laminated ferromagnetic layer being smaller in extent than the previous laminated ferromagnetic layer outside edges. In this manner, there is alignment tolerance in successive lithography steps.

This process allows one to extend to "n" layers from a manufacturing perspective, where "n" greater than two is possible due to the additional photo steps and electroplating steps. Because of these independent masking and plating steps, the edges of the top layer and the edges of the bottom layer are independently defined, thus allowing one to purposefully control the amount of overlap between the layers, which would not be possible using wet etching.

In another approach, the first ferromagnetic layer of a top and/or bottom yoke of a thin film inductor has a greater width than the second ferromagnetic layer thereof in at least one direction, preferably where the second ferromagnetic layer is positioned above the first ferromagnetic layer. In one approach, the edges of the second ferromagnetic layer between which the width is measured are each indented by about 0.5 to about 20 microns from edges of the first ferromagnetic layer aligned generally parallel thereto.

In another approach, the edges of the second ferromagnetic layer of a thin film inductor, between which the width is measured (whichever edges those happen to be), have physical characteristics of being mask-defined. Such characteristics may include vertical sidewalls, a step-like corner or corners, lack of nonuniformities that one would expect from other processes such as milling or etching, etc.

In yet another embodiment, the edges of the second ferromagnetic layer of one or more of the yokes of a thin film inductor, between which the width thereof is measured and edges of the first ferromagnetic layer that are aligned generally parallel to the edges of the second ferromagnetic layer are physically characterized as being independently defined.

Figure 5:
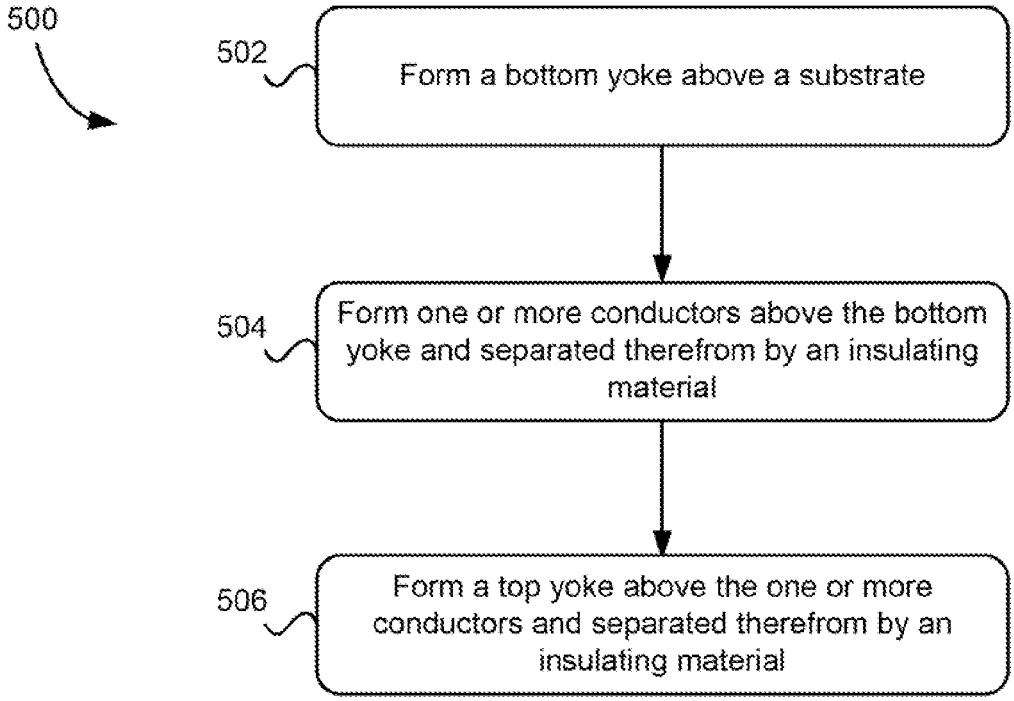
FIG. 5 is a flowchart of a method according to one embodiment.

A method 500 of making a thin film inductor according to one embodiment is depicted in FIG. 5. The method 500, in some approaches, may be performed in any desired environment, and may include embodiments and/or approaches described in relation to FIGS. 1-4B. Of course, more or less operations than those shown in FIG. 5 may be performed as would be known to one of skill in the art.

In step 502, a bottom yoke is formed above a substrate. Any suitable process may be used, such as plating, sputtering, masking and milling, etc. The top and bottom layers of the bottom yoke in this and other embodiments may be constructed of any soft magnetic material, such as iron alloys, nickel alloys, cobalt alloys, ferrites, etc. The nonmagnetic layer between the top and bottom layers may be any nonmagnetic material known in the art, such as ruthenium, copper, gold, alumina, silicon oxides, polymers, etc.

In step 504 of FIG. 5, one or more conductors is formed above the bottom yoke and separated therefrom by an insulating material. Any suitable process may be used, such as sputtering, spincoating, etc. Any electrically insulating material known in the art may be used in this or any other embodiment, such as alumina, silicon oxides, resists, polymers, etc. The conductor(s) may be constructed of any electrically conductive material, such as copper, gold, aluminum, etc. Any known fabrication technique may be used, such as plating through a mask, Damascene processing, conductor printing, sputtering, masking and milling etc.

In step 506, a top yoke is formed above the one or more conductors and separated therefrom by an insulating material, which may be the same as or different than the insulating material between the conductor(s) and the bottom yoke. The top yoke may have the same, a similar, or different compositional structure as the bottom yoke.

One skilled in the art, upon being apprised of the present specification, will appreciate how to adapt known processes to perform the various steps listed herein.

Figure 6A:
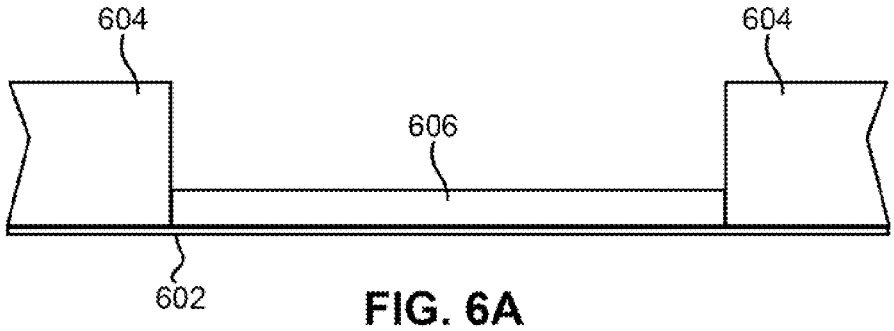
FIG. 6A is a cross sectional view of a fabrication step for a particular laminated yoke configuration
Figure 6B:
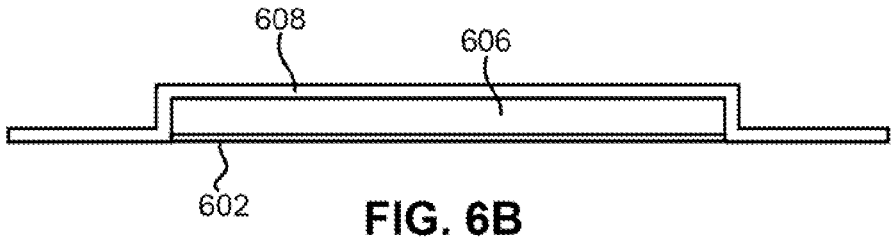
FIG. 6B is a cross sectional view of a fabrication step for a particular laminated yoke configuration
Figure 6C:
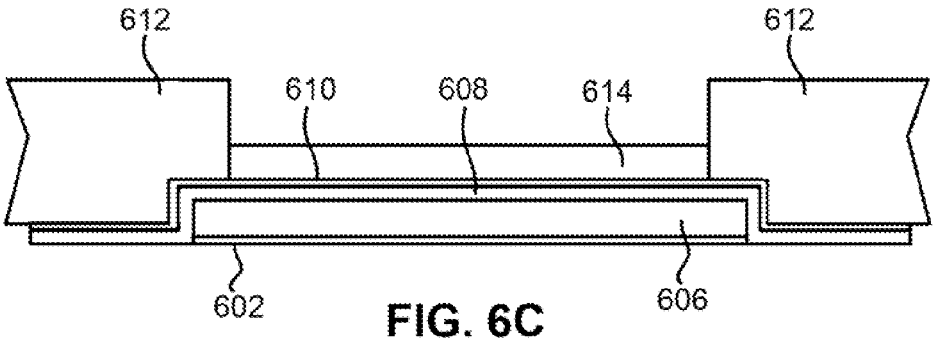
FIG. 6C is a cross sectional view of a fabrication step for a particular laminated yoke configuration

Forming the bottom yoke, as in step 502, and/or forming the top yoke, as in step 506, may include one or more of steps of the illustrative process depicted in FIG. 6A-6D, which include cross sectional views of an illustrative laminated yoke configuration. FIG. 6A depicts depositing a seedlayer 602, applying a first mask 604, followed by plating a first ferromagnetic layer 606 in an area not masked by the first mask 604. FIG. 6B depicts preferably removing the first mask 604, removing exposed portions of the seedlayer 602, and subsequently depositing a nonmagnetic laminate layer 608 above the first ferromagnetic layer 606. FIG. 6C, depicts the optional step of depositing a second seedlayer 610 (such as where the nonmagnetic layer is insulating), applying a second mask 612 above the nonmagnetic layer 608 and plating a second ferromagnetic layer 614 in an area not masked by the second mask 612. FIG. 4D depicts removing the second mask 612, and removing exposed portions of the second seedlayer 610. Preferably, both of the yokes are formed using the sequential versions of the procedure depicted in FIG. 6A-6D.

In one approach, a width of the first ferromagnetic layer is different than a width of the second ferromagnetic layer in a direction parallel to a plane of deposition of the first ferromagnetic layer.

In another embodiment, the first and second ferromagnetic layers are plated, so the nonmagnetic layer is formed by deposited using a dry process such as by sputtering, etc.

Figure 6D:
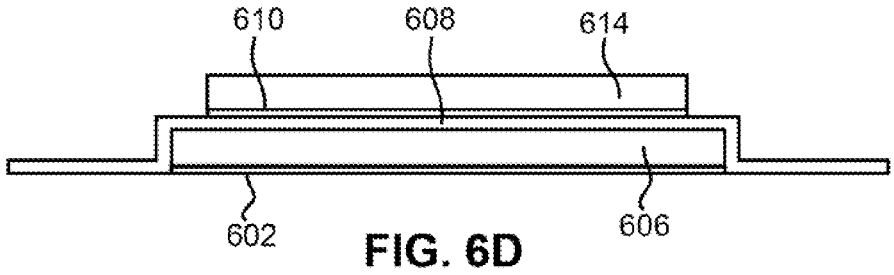
FIG. 6D is a cross sectional view of a fabrication step for a particular laminated yoke configuration

Advantages provided using the methodology of FIGS. 5-6D include the ability to use any insulation material ($SiO_x$, $AlO_x$, SiN, etc.) independent of the requirement that the material be electroplated. Furthermore, it allows for the electroplating of the ferromagnetic lamination layers, resulting in uniform thickness conformality of the ferromagnetic layers in the via regions. Moreover, there is no requirement for the insulator to be etched to produce the shape of the top or bottom yoke, thereby eliminating the disadvantages inherent in performing any wet or dry etching to simultaneously etch the ferromagnetic layer and the insulation layer.

Furthermore, in yet another approach, an electronic device may be formed in, on and/or above the substrate and coupled to an inductor in accordance with any embodiment.

In any approach, the dimensions of the various parts may depend on the particular application for which the thin film inductor will be used. One skilled in the art armed with the teachings herein would be able to select suitable dimensions without needing to perform undue experimentation.

In use, the thin film inductors may be used in any application in which an inductor is useful.

Figure 7:
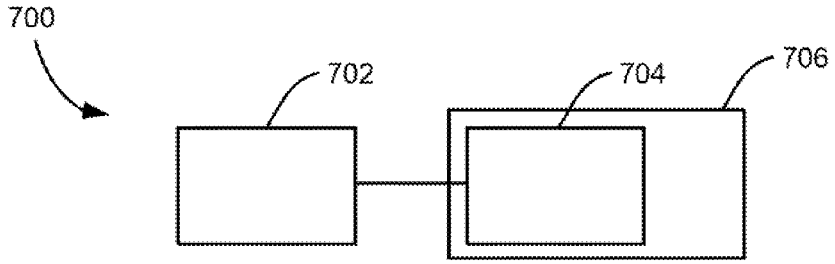
FIG. 7 is a simplified diagram of a system according to one embodiment.

In one general embodiment, depicted in FIG. 7, a system 700 includes an electronic device 702 (which may include circuits as well as more complex devices), and a thin film inductor 704 according to any of the embodiments described herein, preferably coupled to or incorporated into a power supply or power converter 706 used by the electronic device. Such an electronic device may be a circuit or component thereof, chip or component thereof, microprocessor or component thereof, application specific integrated circuit (ASIC), etc. In further embodiments, the electronic device and thin film inductor are physically constructed (formed) on a common substrate. Thus, in some approaches, the thin film inductor may be integrated in a chip, microprocessor, ASIC, etc.

Additional applications, according to various embodiments include power conversion for LED lighting, power conversion for solar power, etc. For example, one illustrative approach may include a solar panel, a power converter having an inductor as described herein, and a battery.

Figure 8:
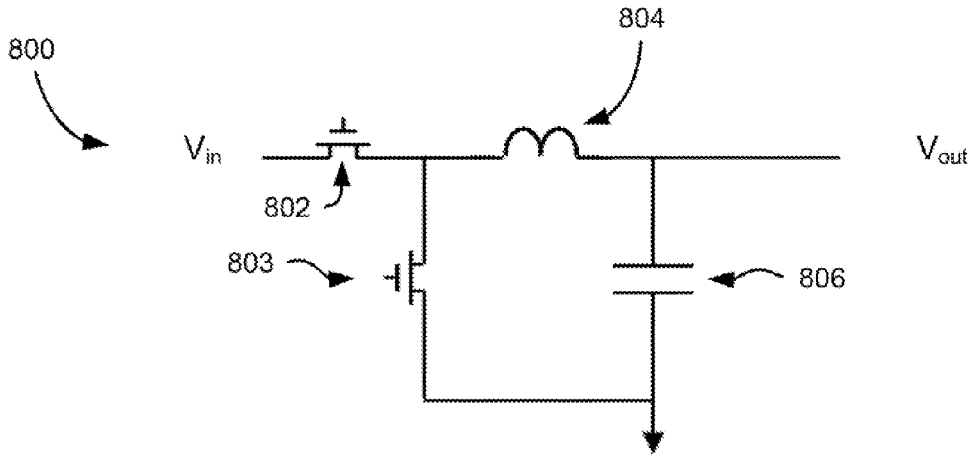
FIG. 8 is a simplified circuit diagram of a system according to one embodiment.

In one illustrative embodiment, depicted in FIG. 8, a buck converter circuit 800 is provided. In this example the circuit includes two transistor switches 802, 803 the inductor 804, and a capacitor, 806. With appropriate control signals on the switches, this circuit will efficiently convert a larger input voltage to a smaller output voltage. Many such circuits incorporating inductors are know to those in the art. This type of circuit may be a stand alone power converter, or part of a chip or component thereof, microprocessor or component thereof, application specific integrated circuit (ASIC), etc. In further embodiments, the electronic device and thin film inductor are physically constructed (formed) on a common substrate. Thus, in some approaches, the thin film inductor may be integrated in a chip, microprocessor, ASIC, etc.

In yet other approaches, the thin film inductor may be integrated into electronics devices where they are used in circuits for applications other than power conversion. The inductor may be a separate component, or formed on the same substrate as the electronic device.

In yet another approach, the thin film inductor may be formed on a first chip that is coupled to a second chip having the electronic device. For example, the first chip may act as an interposer between the power supply or converter and the second chip.

Illustrative systems include mobile telephones, computers, personal digital assistants (PDAs), portable electronic devices, etc. The power supply or converter may include a power supply line, a transformer, etc.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. A thin film inductor, comprising: a bottom yoke; a top yoke above the bottom yoke; one or more conductors passing between the yokes and separated therefrom by an insulating material; wherein at least one of the yokes has a laminate structure comprising a first ferromagnetic layer, a nonmagnetic layer above the first ferromagnetic layer, and a second ferromagnetic layer above the first ferromagnetic layer, wherein a width of the first ferromagnetic layer is different than a width of the second ferromagnetic layer in a direction parallel to a plane of deposition of the first ferromagnetic layer; wherein the first ferromagnetic layer has a greater width than the second ferromagnetic layer, wherein the second ferromagnetic layer is positioned above the first ferromagnetic layer.

2. The thin film inductor as recited in claim 1, wherein both of the yokes have the laminate structure.

3. The thin film inductor as recited in claim 1, wherein edges of the second ferromagnetic layer between which the width is measured are each indented by about 0.5 to about 20 microns from edges of the first ferromagnetic layer aligned generally parallel thereto.

4. The thin film inductor as recited in claim 1, wherein edges of the second ferromagnetic layer between which the width is measured have physical characteristics of being mask-defined.

5. The thin film inductor as recited in claim 1, wherein edges of the second ferromagnetic layer between which the width thereof is measured and edges of the first ferromagnetic layer aligned generally parallel to the edges of the second ferromagnetic layer are physically characterized as being independently defined.

6. The thin film inductor as recited in claim 1, wherein the nonmagnetic layer is electrically insulating.

7. The thin film inductor as recited in claim 1, wherein the first and second ferromagnetic layer are plated layers.

8. The thin film inductor as recited in claim 1, where the laminate structure of the at least one of the yokes further comprises a second nonmagnetic layer above the second ferromagnetic layer, and a third ferromagnetic layer above the second nonmagnetic layer.

9. A system, comprising:

an electronic device; and a power supply or power converter incorporating a thin film inductor as recited in claim 1.

10. The system as recited in claim 9, wherein the thin film inductor and the electronic device are physically constructed in, on and/or above a common substrate.

11. The system as recited in claim 9, wherein both of the yokes have the laminate structure.

12. The system as recited in claim 9, wherein the first ferromagnetic layer has a greater width than the second ferromagnetic layer, wherein the second ferromagnetic layer is positioned above the first ferromagnetic layer.

13. The system as recited in claim 9, wherein edges of the second ferromagnetic layer between which the width is measured have physical characteristics of being mask-defined.

14. The system as recited in claim 9, wherein edges of the second ferromagnetic layer between which the width thereof is measured and edges of the first ferromagnetic layer aligned generally parallel to the edges of the second ferromagnetic layer are physically characterized as being independently defined.

15. The system as recited in claim 9, wherein the first and second ferromagnetic layer are plated layers.

* * * * *